US005800044A

United States Patent [19]

Marshall

[11] Patent Number: 5,800,044

[45] Date of Patent: Sep. 1, 1998

[54] COMBINATION MAN OVERBOARD PERSONAL RESCUE LIGHT

[76] Inventor: Richard S. Marshall, 1828 37th East, Seattle, Wash. 98112

[21] Appl. No.: 788,081

[22] Filed: Jan. 22, 1997

Related U.S. Application Data

[60] Provisional application No. 60/033,297, Dec. 10, 1996.

[51] Int. Cl.[6] ..... F21L 7/00

[52] U.S. Cl. ..... 362/158; 362/184; 362/186; 362/202; 362/205

[58] Field of Search ..... 362/158, 184, 362/185, 186, 202, 205

[56] References Cited

U.S. PATENT DOCUMENTS

| | | | |
|---|---|---|---|
| 1,946,059 | 2/1934 | Buchholz | 362/184 |
| 2,355,247 | 8/1944 | Slocum | 362/148 |
| 2,366,929 | 1/1945 | Pfeil | 441/16 |
| 2,377,161 | 5/1945 | Le Strange et al. | 441/17 |
| 2,377,194 | 5/1945 | Van Daalen | 362/158 |
| 2,427,017 | 9/1947 | Miller | 362/158 |
| 2,558,870 | 7/1951 | Michelman | 441/17 |
| 2,765,481 | 10/1956 | Manhart et al. | 441/17 |
| 2,971,081 | 2/1961 | Shimizu | 362/158 |
| 3,264,463 | 8/1966 | Bonner, Jr. | 362/158 |
| 3,323,118 | 5/1967 | Chan | 340/341 |
| 3,535,506 | 10/1970 | Moore et al. | 362/184 |
| 3,798,692 | 3/1974 | Madeley | 441/89 |
| 4,274,130 | 6/1981 | Elliot | 362/184 |
| 4,782,432 | 11/1988 | Coffman | 362/184 |
| 4,985,813 | 1/1991 | Putman | 362/186 |
| 5,029,293 | 7/1991 | Fontanille | 340/573 |
| 5,326,297 | 7/1994 | Loughlin | 441/89 |
| 5,370,566 | 12/1994 | Mitchell, Jr. et al. | 441/89 |
| 5,667,293 | 9/1997 | Own | 362/184 |

FOREIGN PATENT DOCUMENTS

| | | | |
|---|---|---|---|
| 57-87788 | 6/1982 | Japan . | |
| 2 089 015 | 6/1982 | United Kingdom | 362/158 |

OTHER PUBLICATIONS

Article entitled "Personal Man–Overboard Lights: Ray of Hope if You Go Over thee Side?" Ron Dwelle, appearing in Practical Sailor, Issue of Jun. 1, 1988 at pp. 4–8.

Part of Article appearing in Experimental Aircraft Association Sport Aviation Magazine, issue of Dec. 1996, at pp. 83 and 84.

Article entitled "Forespar RL–2 Best Buy in Personal Distress Lights", appearing in Practical Sailor issue of Dec. 1994, at pp. 13–16.

*Primary Examiner*—Ira S. Lazarus
*Assistant Examiner*—Ljiljana V. Ciric
*Attorney, Agent, or Firm*—Graybeal Jackson Haley LLP

[57] ABSTRACT

A waterproof man overboard personal rescue light unit for use in detecting, locating, raging to, engaging, and rescuing personnel needing rescue is disclosed as having a body having a closed lower end and an upper end; a steady state light located proximate to the upper end of the body so as to emit a generally hemispherical light pattern when energized; a non-incandescent strobe light located proximate to the upper end of the body so as to emit a generally hemispherical light pattern when energized; at least one switch for electrically coupling the steady state light and the non-incandescent strobe light to a source of electrical power; a lens matable to the upper end of the body to create a waterproof enclosure defined by the body and the lens, and to permit a generally hemispherical emission pattern of light generated by the steady state light and the non-incandescent strobe light. The unit is preferably buoyant and attachable to a user by way of a tether. Depending upon applications, both light sources may be controlled by a single switch or by separate switches. In preferred form, the body houses disposable or rechargeable batteries to power the unit.

9 Claims, 2 Drawing Sheets

COMBINATION MAN OVERBOARD PERSONAL RESCUE LIGHT

CROSS REFERENCE TO RELATED APPLICATION

This application includes and is in part based on the disclosure found in provisional application 60/033,297, entitled COMBINATION MAN OVERBOARD PERSONAL RESCUE LIGHT, and filed Dec. 10, 1996.

BACKGROUND OF THE INVENTION

1. Field of the Invention

The present invention relates to marine rescue apparatus and more particularly to man overboard personal rescue lights of the type to be worn or otherwise accompany a person remotely afloat at sea and needing to be located and rescued. The lights utilize both strobe and steady state incandescent lights for the purpose.

2. Description of the Prior Art

In general, rescue lights used by personnel at sea and in need of being located and rescued have involved use of incandescent lights either steady state or intermittently operated as disclosed in Fontanille U.S. Pat. No. 5,029,293. An example of such lights operated on a steady state basis is found in Mitchell U.S. Pat. No. 5,370,566. It is also known to energize such lights by a water-actuated switching means, such as disclosed in Madeley U.S. Pat. No. 3,798,692. Loughlin U.S. Pat. No. 5,326,297 is also of interest for its disclosure, in connection with a life jacket having various safety devices, of the use of a strobe light which the life jacket wearer mounts on his head with a chin strap.

Known as well is use of a Thyratron-type strobe light device on a life jacket such as disclosed in Japanese patent application publication 57-87788 dated Jun. 1, 1982.

In general, usage and testing of various types of lights for location and rescue of personnel at sea have shown that a white or colored incandescent light is much better than a strobe light for ranging to and engaging a given light source, but the intensity of an incandescent light is inadequate, even at a range of one-and-one-half miles for initial detection of such personnel. For detection at a greater distance, a strobe light is much better, being readily detectable to two miles with the naked eye and to some three miles with 7×50 binoculars under good conditions. A strobe light is poor for ranging to and engaging a light source due to its short flash duration and its nature (blue-white light), even when one is close aboard the light. For some observers, an extended exposure to a strobe light can also develop a hypnotic response. The difficulty of ranging on a strobe light is a particularly troublesome problem for rescue helicopter pilots since it is difficult to realize good depth perception on a light of such short duration.

Commercial and general aviation aircraft employ lighting systems which combine bright fixed incandescent lights with strobe lights and effectively provide both location and ranging to all observers. Notwithstanding, there appears to have been no effort heretofore to provide combined incandescent and strobe lighting for marine personnel rescue purposes.

SUMMARY OF THE INVENTION

It is an object and feature of the present invention to provide man overboard personal rescue lights which combine separately controllable and simultaneously or sequentially usable strobe and fixed incandescent lights and which, as a result of such combined lighting, provide more effective initial detection of a person needing rescue and also more effective homing in and engagement thereof by the rescuer. Improved attention-getting and location and ranging through a combination of strobe and fixed incandescent lighting offers the potential of substantially improving the chances of a prompt and safe rescue of lost overboard marine personnel.

It is a further object and feature of the present invention to provide a combined strobe/incandescent signal lighting apparatus as a single unit which is relatively economical and simple to manufacture, is storable without degradation over long periods, and is simple to operate in emergency situations.

It is a further object and feature of the present invention to provide, for use in detecting, locating, ranging to, engaging and rescuing personnel at sea, rescue light unit which accompanies and is under control of a downed person needing rescue and comprises a combination of a steady state incandescent light and a strobe light, with at least the strobe light independently engergizable by the downed person needing rescue and with the unit having a waterproof housing of molded plastic and a bubble-type lens through which the lights are viewable and which may be floatable in the water or can be worn by or tethered from such person to improve the likelihood of initial detection of the strobe light by those searching for the downed person.

Yet a further objects and feature of the present invention is to provide a man overboard personal rescue light having both a steady state incandescent light and a separately controllable strobe light which is usable by a person equipped with the unit to maintain the strobe light energized until and during initial detection and location by rescuers and then use only the incandescent light during ranging to and engagement of the person by rescuers.

These and other characteristics, advantages and features of the present invention will occur to those skilled in the art to which the invention is addressed in the light of the disclosure presented by the accompanying drawings and following description.

DETAILED DESCRIPTION OF THE PREFERRED EMBODIMENT

Figure 1:
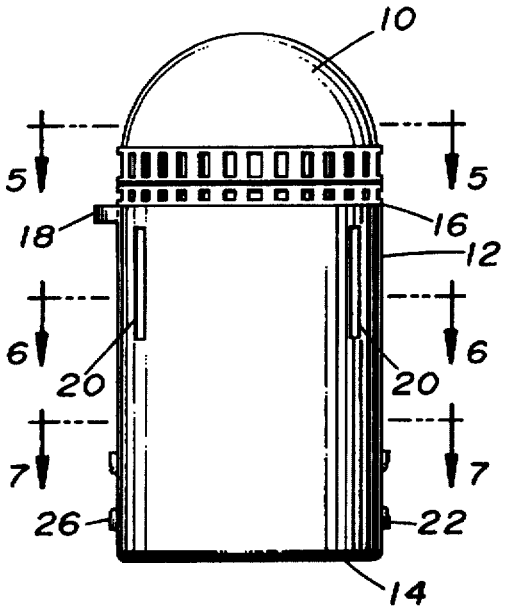
FIG. 1 is a front elevational view of a preferred embodiment of the invention.
Figure 3:
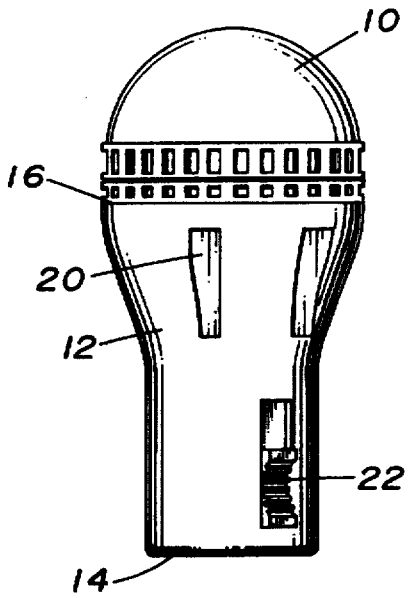
FIG. 3 is a left side elevational view thereof.
Figure 2:
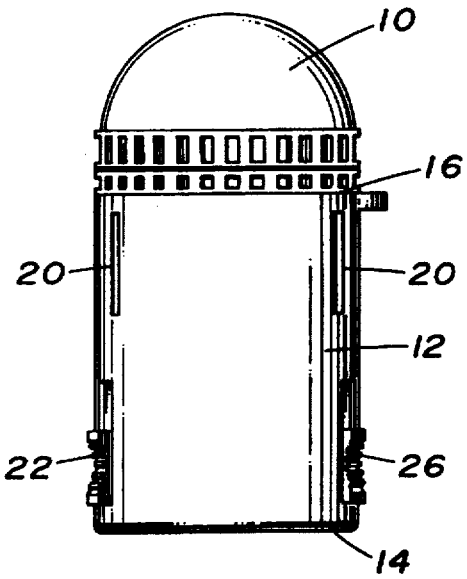
FIG. 2 is a rear elevational view thereof.
Figure 4:
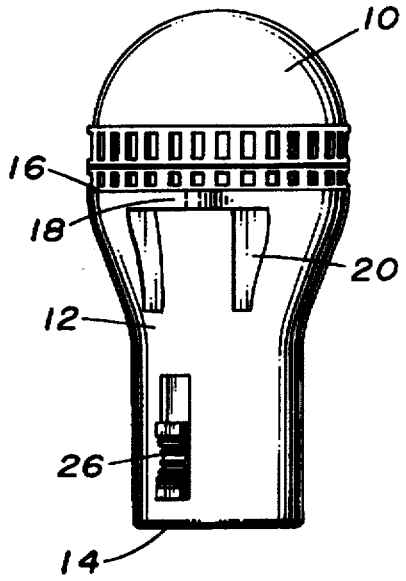
FIG. 4 is a right side elevational view thereof.
Figure 5:
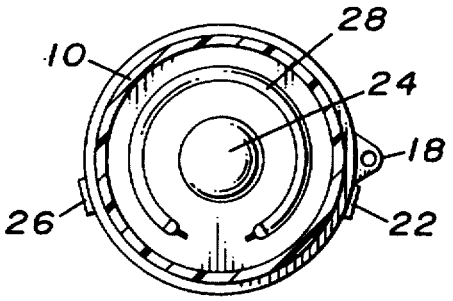
FIG. 5 is a horizontal cross-sectional view taken substantially along a plane indicated at 5—5 on FIGS. 1–4.
Figure 6:
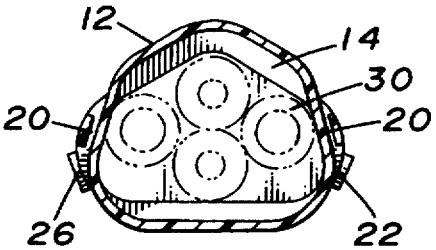
FIG. 6 is a horizontal cross-sectional view taken substantially along a plane indicated at 6—6 on FIGS. 1–4.

As shown in the accompanying drawings, the combined rescue light unit illustrated comprises a bubble-type lens 10 which is in threaded engagement with the main body 12 of the unit, which has a closed lower end 14 and an open upper end 16. Both the bubble lens 10 and main body 12 are suitably formed of molded plastic. Bubble lens 10 can be either clear or a light translucent color and the main body 12 is suitably a bright opaque color such as red. The main body 12 includes externally a tether attachment 18 to which a tether line of appropriate length (e.g., 6 feet), not shown, can be attached. Slots 20 for attachment of a strap means (not shown) to attach the unit to the downed person is also provided. Switch 22 is for energization of the incandescent light 24 and switch 26 is for energization of the strobe light 28. As shown in FIGS. 6–10, the unit is powered by four AA batteries, conventional per se and indicated as a group at 30, and the electrical circuitry also comprises an electronic circuitry housing 32 and its module 34, including strobe light power supply circuitry which is conventional per se.

Figure 8:
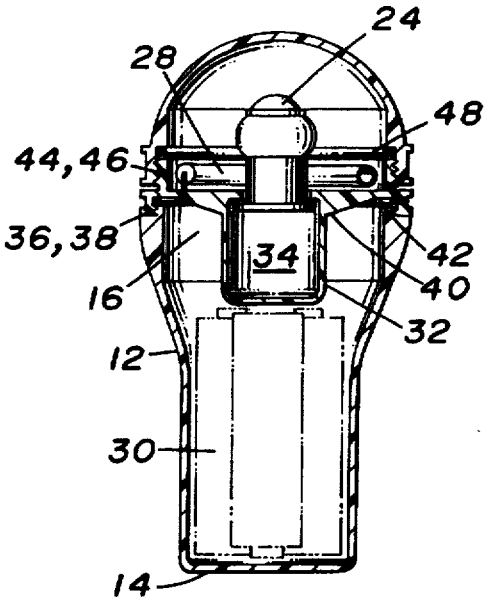
FIG. 8 is a vertical cross-sectional view taken substantially along a plane indicated at 8—8 on FIGS. 5 and 7.
Figure 7:
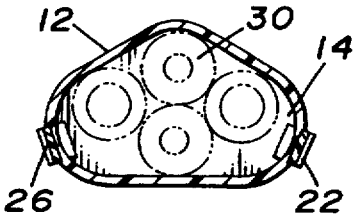
FIG. 7 is a horizontal cross-sectional view taken substantially along a plane indicated at 7—7 on FIGS. 1–4.
Figure 9:
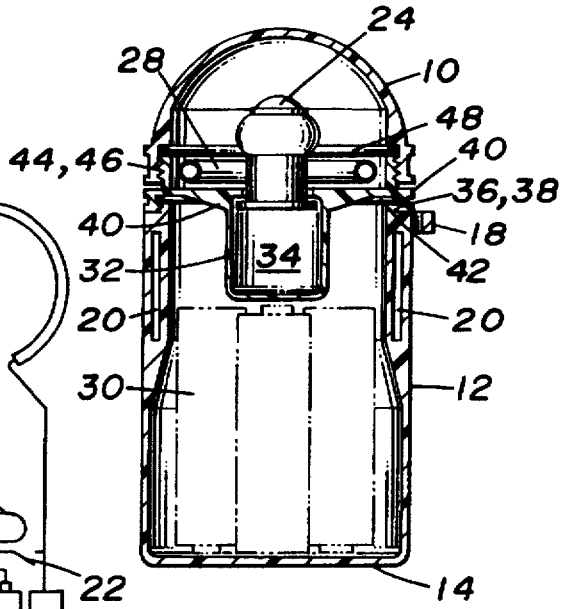
FIG. 9 is a vertical cross-sectional view taken substantially along a plane indicated at 9—9 on FIGS. 5 and 7.
Figure 10:
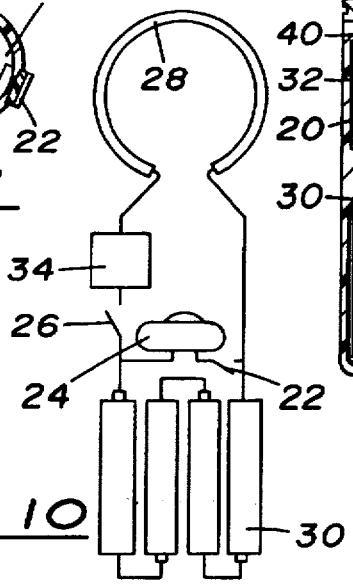
FIG. 10 is a schematic of the electrical components and circuitry of the combined light shown in FIGS. 1–9.

As shown in FIGS. 8 and 9, interengaging threads 36 at the upper end 16 of main body 12 and threads 38 on light mounting plate 40 along with O-ring 42 provide a waterproof interconnection between the main body 12 and the light mounting plate 40. Similarly, upper threads 44 and rim threads 46 on bubble lens 10 together with O-ring 48 therebetween provide a waterproof interconnection between the bubble lens 10 and the mounting plate 40 to render the entire unit waterproof when fully assembled yet provide for ready disassembly for replacement of either the batteries 30 or the lights 24 and 28.

The combined light unit is preferably designed to float and can be attached to the wearer by a strap or clip means. Floatation allows it to be released on a tether line attached at 18 which is oftentimes desirable in use so that the unit can float away from obscuration by the wearer's body.

As a typical example of the components of a combined strobe light and incandescent fixed light unit according to the present invention, strobe light tube 28 is similar to that used in Model 380A Personal Safety strobe light available from Guest Industries Division of Valley Forge Corp., 48 Elm Street, Meridian, Conn. 06450, the strobe light power circuitry for electronic circuitry module 34 is like that found in the Firefly$_2$® rescue strobe light available from ACR Electronics Inc., 5757 Ravenswood Road, Ft. Lauderdale, Fla. 33312, the externally accessible strobe light and incandescent light switches 22 and 26 are similar to the corresponding switches on respective personal floatation device lights Models 731 and 733 available from ACR Electronics Inc., and the incandescent lamp 24 is similar to that used in the Model I900 Rescue Mate™ rescue light available from Stearns Manufacturing Co., P.O. Box 1498, St. Cloud, Min. 56302.

Various further modifications, adaptations and arrangements of the unit components will occur to those skilled in the art to which the invention is addressed within the scope of the following claims.

What is claimed is:

1. A waterproof personal rescue light unit comprising:

a body having a closed lower end and an upper end;

a steady state light located proximate to the upper end of the body so as to emit a generally hemispherical light pattern when energized;

a non-incandescent strobe light located proximate to the upper end of the body so as to emit a generally hemispherical light pattern when energized;

at least one switch for electrically coupling the steady state light and the non-incandescent strobe light to a source of electrical power;

a lens matable to the upper end of the body to create a waterproof enclosure defined by the body and the lens, and to permit a generally hemispherical emission pattern of light generated by the steady state light and the non-incandescent strobe light.

2. The unit of claim 1 wherein a first switch electrically couples the steady state light to a source of electrical power and a second switch electrically couples the non-incandescent strobe light to a source of electrical power.

3. The unit of claim 1 wherein the lens is a clear curvilinear lens.

4. The unit of claim 1 further comprising electronic components for use in conjunction with the non-incandescent strobe light, the components being disposed substantially within the body.

5. The unit of claim 1 wherein the body is formed to receive a portable source of power and the unit further comprises a portable source of power.

6. The unit of claim 5 wherein the portable source of power is at least one battery.

7. The unit of claim 1 further comprising tether attaching means.

8. The unit of claim 1 wherein the unit is buoyant in water and is self orienting when placed therein so as to place the lower end of the body below the lens.

9. A waterproof personal rescue light unit comprising:

a body having a closed lower end and an upper end;

a steady state light located proximate to the upper end of the body so as to emit a generally hemispherical light pattern when energized;

a non-incandescent strobe light located proximate to the upper end of the body so as to emit a generally hemispherical light pattern when energized;

electronic components for use in conjunction with the non-incandescent strobe light, the components being disposed substantially with in the body a first switch for electrically coupling the steady state light to a source of electrical power and a second switch for electrically coupling the non-incandescent strobe light to a source of electrical power;

a bubble lens matable to the upper end of the body to create a waterproof enclosure defined by the body and the lens, and to permit a generally hemispherical emission pattern of light generated by the steady state light and the non-incandescent strobe light.

* * * * *